US005753077A

United States Patent [19]

Horand et al.

[11] Patent Number: 5,753,077

[45] Date of Patent: May 19, 1998

[54] WEB PRINTING PAPER AND PROCESS FOR PRODUCING IT

[75] Inventors: Dieter Horand, Niederkrüchten; Adam Gürtler, Düsseldorf; Paul Heinz Dähling, Elsdorf-Esch; Bernd Pelech, Willich, all of Germany

[73] Assignee: Stora Feldmühle AG, Düsseldorf, Germany

[21] Appl. No.: 507,267

[22] PCT Filed: Jan. 28, 1994

[86] PCT No.: PCT/EP94/00248

§ 371 Date: Sep. 21, 1995

§ 102(e) Date: Sep. 21, 1995

[87] PCT Pub. No.: WO94/19537

PCT Pub. Date: Sep. 1, 1994

[30] Foreign Application Priority Data

Feb. 19, 1993 [DE] Germany ..... 43 05 134.0

[51] Int. Cl.[6] ..... D21H 11/14; D21H 19/84; D21H 19/36

[52] U.S. Cl. ..... 162/135; 162/137; 162/147; 162/183; 162/181.1; 162/181.7; 162/157.6; 428/341; 428/342; 428/331

[58] Field of Search ..... 162/135, 136, 162/137, 147, 183, 184, 181.1, 181.2, 181.5, 181.7, 181.8, 157.6; 428/340, 341, 342, 326, 331, 330

[56] References Cited

U.S. PATENT DOCUMENTS

| | | | |
|---|---|---|---|
| 4,298,652 | 11/1981 | Suzuki et al. | 428/323 |
| 4,425,405 | 1/1984 | Murakami et al. | 428/342 |
| 4,478,910 | 10/1984 | Oshima et al. | 428/331 |
| 5,302,437 | 4/1994 | Idei et al. | 428/195 |

FOREIGN PATENT DOCUMENTS

| | | | |
|---|---|---|---|
| 0377983 | 7/1990 | European Pat. Off. . | |
| 1174697 | 7/1989 | Japan . | |
| 4-182184 | 6/1992 | Japan | D21H 5/00 |

OTHER PUBLICATIONS

"Möglichkeiten zum On-line-Streichen von hochgefüllten, holzhaltigen Papieren"; Glittenberg et al.; Wochenblatt fur Papierfabrikation, 13, 1992, pp. 505–515.

"Pigmentieren mit der Filmleimpresse"; Rantanen; Wochenblatt für Papierfabrikation 6, 1992, pp. 193–197.

"Zur Ordnung der Verfahren der mechanischen Zerfaserung von Holz" Blechschmidt; Zellstoff und Papier 37, 1988, pp. 212–213.

Wochenblatt Für Papierfabrikation, 9, 1988, pp. 337–344; "Studie über Bindemittelsysteme für LLWC–und MFP–Papiere" N.O. Bergh et al.

Wochenblatt Für Papierfabrikation, 16, 1990 pp. 701–708; "Oberflächenbehandlug von Zeitungsdruckpapier . . . " N.O. Bergh, et al.

"Upgrading of newsprint by surface treatment" Bergh et al.; Pulp & Paper Canada 92:4 (1991) pp. 52–58.

"The Production of High Quality Upgraded Newsprint By An On Machine Surface Treatment with LAS", Akesson et al; Eucepa Conference Proceedings (1988) pp. 538–555.

"Improving the quality of newsprint with fillers" Koppelman et al.; Tappi Journal, Nov. 1986 pp. 74–78.

"Oberflächenbeschichtete SC–Papiere, eine Herausforderung für LWG–Papiere"; Baumeister et al.; Wochenblatt Für Papierfabrikation, 1, 1988, pp. 1–6.

*Primary Examiner*—Donald E. Ozaja
*Assistant Examiner*—Jose A. Fortuna
*Attorney, Agent, or Firm*—Cohen, Pontani, Lieberman, Pavane

[57] ABSTRACT

In a web printing paper the base paper comprises of more than 50% wt. de-inked recycled fibers, 10–35% wt. mineral filler and the remainder being wood-pulp and/or cellulose and has a weight of 30 to less than 60 g/m$^2$. The base paper is coated with a coating having a weight of 2 to 8 g per m$^2$ and side and the binder proportion is no more than 15% wt. in relation to the coating pigment.

41 Claims, No Drawings

WEB PRINTING PAPER AND PROCESS FOR PRODUCING IT

FIELD OF THE INVENTION

The present invention relates to a web printing paper, which has a base paper containing mineral filler, recycled fibers and, as applicable, mechanical pulp and/or chemical pulp, and a coating on both sides containing pigment and binder. Furthermore, the invention relates to a process for producing the web printing paper.

BACKGROUND OF THE INVENTION

Basically, there are three main groups of press papers:

Newsprint

Super-calendared (SC) paper

Lightweight-coated (LWC) paper

The above-mentioned papers are used in the production of daily newspapers, illustrated periodicals, magazines, catalogs and advertising circulars, such as those usually included with daily newspapers or illustrated periodicals.

In the past, there were many attempts to improve the quality of these papers while at the same time reducing production costs. This led to upgraded newsprint being used in areas which originally were reserved for the higher-value SC papers; in turn, SC papers of improved quality could be used where only LWC papers had been used in the past.

An overview of the current press papers may be found in the "Paper Manufacturing Weekly" (*Wochenblatt für Papierfabrikation*) 9 (1988), pp. 337–344. This study also describes a film press used to apply preparations to the paper types in question. SC papers and LWC papers are largely printed by the offset or gravure process, while newsprints and upgraded newsprints are printed almost exclusively by the offset process. Because the papers mentioned are supplied to the printing machine exclusively in the form of webs, they are also referred to collectively as "web printing papers." In this study, the fiber composition of known European wood-containing offset papers is given as 4 to 50% chemical pulp, remainder: mechanical pulp. The ash content of newsprints is given as 0 to 7%, and for SC papers 18 to 25%. The use of recycled fibers is not addressed.

The authors Bergh and Svenka report in the "Paper Manufacturing Weekly" 16 (1990), pp. 701–708 and in "Pulp and Paper Canada" 92: 4 (1991), pp. 52–58 on the surface treatment of newsprint with starch or pigmentations in order to improve printability. Even a surface treatment carried out solely with starch leads, at a applied coat of 1 g/m$^2$, to improved surface binding, resulting in a paper suitable for multicolor offset printing. The reduced whiteness, however, was disadvantageous. When, instead, a starch solution based on calcium carbonate or kaolin and preparations containing 70% by weight starch ester, relative to the pigment, were applied with a so-called film press, a quality of improved strength and printability was created that could no longer be termed newsprint. Depending on the selected satinage conditions—super-calendar (SC) or soft-compact-calendar (SCC)—smoothness values between a maximum of <200 (SCC) and 1,000 Bekk/sec. (SC) were obtained. The base paper used for the starch/pigment application contained TMP (thermo-mechanical pulp) as its main fiber components and an ash content of 0.4% weight.

The article: "The Production of High-Quality Upgraded Newsprint by an On-Machine Surface Treatment with LAS (Liquid Application System)," Eucepa Conference Proceedings (1988), pp. 538–555 reports on the surface treatment of newsprint with starch, CMC or other film-formers and on the application of a lightly pigmented coating. The produced product is to said to fall between LWC and SC papers. The application of the surface preparation is, according to the article, carried out with the devices known as short-swell coaters or LAS. Better base papers, in respect to strength, can be coated using the short-dwell system, while papers of lower strength can only be processed on an LAS device. If pigmented preparations are used, they have compositions of 50% coating kaolin and 50% finely-ground calcium carbonate and contain binder shares of between 50 and 200 parts by weight, relative to 100 parts by weight pigment. If latex is also used as a binder, its share of the total binder quantity is 10%. The prepared papers are subsequently treated on a super-calendar. If only starch has been applied, a considerable increase in tensile strength as well as a lesser—and, depending on the applied starch quantity, lessening—increase in stiffness is observed. On the other hand, opacity increases considerably when the applied preparation consists solely of starch. The application of pigmented preparations, in which the preparation having the lowest binder content consists of 33% by weight binder and 67% by weight pigment, also led to improvement in characteristics, particularly in picking resistance, gloss and printing gloss, especially when the produced papers were also super-calendared; however, depending on the application device used, a considerable deterioration in opacity occurred.

The composition of the base paper used, especially any share of recycled fibers present, the filler content and the grammage of the base paper, are not disclosed.

A further experiment to improve the quality of newsprint is described in the Tappi Journal, November 1986, pp. 74–78. This report describes a filler added in the form of kaolin, up to an added quantity of 7% by weight, and the influence of various retention aids. The reported fiber composition of sheets produced in laboratory attempts was 89% TMP and 11% semi-bleached cellulose.

From the Japanese document laid open to public inspection No. 1174697, a newsprint is known, the fiber composition of which consists of 50% by weight mechanical pulp, 30% by weight recycled fibers and 20% by weight sulfate chemical pulp, and which has a coating of 3 to 8 g/m$^2$ and side. The coating pigments have an oil absorption capacity of at least 65 cm$^3$/per 100 g. The coated paper has a whiteness of 61.8, while the base paper has a whiteness value of only 50.7.

EP-0 377 983 A2 relates to a further development of the proposal according to the above-mentioned document; in addition, however, it calls for an acicular pigment in the coating, which is to be applied by means of an air brush or a blade-coater. The coating weight to be applied to an untreated paper containing 30% by weight recycled fibers is to be between 1 and 12 g/m$^2$, preferably between 3 and 8 g/m$^2$ and on the printed side. All told, a grammage of 60 g/m$^2$ should not be exceeded. According to this document, the standard pigments can be used as fillers for the untreated paper; their share is usually between 0.5 and 10% by weight, preferably, however, it is even less than 0.5%. For satinage, a super-calendar and/or a machine smoothing unit is used.

The article "Surface-Treated SC Papers, a Challenge for LWC Papers" (*Oberflächenbeschichtete SC-Papiere, eine Herausforderung für LWC Papers*), published in the "Paper Manufacturing Weekly" 1 (1988), pp. 1 to 6, is concerned with the coating of highly-filled, wood-containing printing papers for illustrateds. The coating formulations given in this article for a paper to be printed by the offset process has a binder-pigment ratio of 0.5: 1 to 1:1. The high binder share is considered necessary in order to attain sufficient anchoring of the coating and a corresponding increase in the strength of the base paper. In quality comparison to the known LWC papers, the surface-treated SC papers have a lower whiteness, a higher opacity, and a clearly lower paper gloss. The ash content (filler content) of the surface-treated SC papers described in this article is between 15 and 25% by weight. As the application device for the coating, an SDTA application system (short dwell time) is indicated. The fiber composition of the untreated paper is not disclosed.

According to the recently published article: "Possibilities for the On-line Coating of Filled, Wood-Containing Papers" (*Möglichkeiten zum On-Line Streichen von gefüllten, bolzhaltigen Papieren*) in the "Paper Manufacturing Weekly" 13 (1992), pp. 507–515, highly-filled upgraded SC papers are pretreated initially by means of a film press with a pigmentation consisting of calcium carbonate and at least 30% by weight binder, relative to the pigment, so that the papers have adequate strength to be coated with the actual top coat in a second workstep by means of a blade-coater.

The top coats consist of mixtures of kaolin and fine calcium carbonate, whereby 12 parts by weight binder [are used] in a 100 parts by weight pigment mixture. The minimum application quantity for the cover coat is 7 g/m$^2$ and side; by way of example, reference is made to application weights up to a total of 19 g/m$^2$, while for the pre-coat 4 to 5 g/m$^2$ are indicated, so that at least 9 g/m$^2$ and side are applied. There is no information given on the fiber material of the base paper. Although the produced papers, which represent a new type of coated paper quality, have some excellent characteristics, disadvantages continue to exist; the relatively high consumption of resources, in connection with the high costs of the base paper, the required double coat, and the high weight of the top coat, results in a paper which due to its production costs must remain excluded from significant areas of use.

The known proposals have led, in part, to new types of web printing papers which have already made their way onto the market; however, the basic disadvantage, namely, that the achieved improvements in quality are accompanied by considerably higher production costs, continues to exist. For example, if an upgraded newsprint achieves the quality level of a standard SC paper or if an upgraded SC paper approaches the quality level of the known LWC papers, a simultaneous increase in costs to the level of the higher-valued type of paper could until now hardly be avoided, so that printers, as customers, had no great incentive to switch over to the newly-developed types of paper. From the environmental point of view, there is the disadvantage that the use of recycled fibers is often still too low.

SUMMARY OF THE INVENTION

The object of the present invention is to provide web printing papers having a satisfactory quality level, to increase the share of recycled fibers used and to permit web printing papers to be manufactured at favorable production costs. In particular, the invention intends to provide a web printing paper for gravure and offset printing, which is to be used in the areas previously reserved for the standard SC papers, while a further web printing paper for gravure and offset printing is to be developed that can be used in the areas of the standard LWC papers.

In implementing the invention, the starting point was the realization that it is necessary, in order to maintain the desired spectrum of characteristics, especially printability, to coat the surface of the paper with a covering known as a coating or pigmentation, which contains binder and mineral pigments. At the same time, however, economic considerations require that the costs for this coating be kept as low as possible. Furthermore, it was recognized that in order to achieve a satisfactory cost/quality ratio, it would be necessary during the production of the paper to make use of an economical fiber material.

Starting from these considerations, a first embodiment of the invention calls for a web printing paper in which, on a base paper containing mineral filler, recycled fibers, mechanical pulp and/or chemical pulp, a coating containing pigment and binder is applied to both sides, whereby the web printing paper is characterized by the fact that:

the base paper has a grammage of 30 to <60 g/m$^2$ the base paper, relative to its grammage, contains:

>50% by weight de-inked recycled fibers 10 to 35% by weight mineral filler remainder: mechanical pulp and/or chemical pulp and all weight parts add up to 100% by weight;

the coating is applied on each side in a quantity of 2 to 8 g/m$^2$ and the binder, relative to pigment of the coating is present in a quantity of not more than 15% by weight. The production of the base paper in accordance with the present invention is preferably carried out at a pH value of between 6.5 and 8.5.

In contrast to the above-described embodiment of the web printing paper according to the invention, it is foreseen according to a further embodiment that the fiber content of the base paper will consist solely of de-inked recycled fibers. Filler content and coating, however, will correspond to the above-described embodiment.

DETAILED DESCRIPTION OF THE PRESENTLY PREFERRED EMBODIMENTS

Before discussing in greater detail the advantages of the present invention, its further advantageous embodiments and the process for manufacturing the web printing paper according to the invention, we shall explain the terms used in the Description and in the Patent Claims:

The web printing paper according to the invention refers exclusively to single-ply papers, in contrast to cardboard, for example.

Filler refers to the mineral pigments that are added to the fiber suspension during paper manufacture. No distinction is made here between freshly added fillers and fillers which are added to the paper manufacturing process together with fiber material recovered from waste paper. Recycled fibers are fiber material recovered from waste paper; according to the invention, especially those fibers are preferred which are recovered from Waste Paper Category D31 on the list of German standard types.

De-inked recycled fibers are fibers from which the printing ink has been removed to the greatest extent possible.

Mechanical pulp refers to wood fibers mechanically reduced in size, i.e., to both the so-called groundwoods and to the types obtained with the help of refiners. A list of the various types of mechanical pulp is found in "Cellulose and Paper" (*Zellstoff and Papier*) 37 (1988), p. 212. Of the types of mechanical pulp listed there, the so-called TMP material (thermo-mechanical pulp) is especially preferred according to the invention.

Mechanical pulp and chemical pulp refer to "fresh" fibers, in contrast to recycled fibers based on mechanical pulp or chemical pulp.

The formulation, which is used in connection with the production of the base paper, of a simultaneous two-side dewatering between two wires of a paper machine refers to manufacture on a wire part known as a twin-former on a paper machine.

The term film press is used here to identify all devices in which pre-dosing of coating color is carried out by means of dosing rollers, blades and smooth or ridged rolling blades on a transfer roller, from which the pre-dosed coating color is "indirectly" transferred to the base paper web in order to form the coating. Further explanations are contained in the reference materials discussed above: "Paper Manufacturing Weekly" 13 (1992), pp. 507 to 515, as well as "Paper Manufacturing Weekly" 6 (1992), pp. 193–197.

Hot-soft calendars are also known in the profession as soft-compact calendars; the nips consist of a hot hard-cast roller and rollers cooperating therewith having resilient plastic; see also the "Paper Manufacturing Weekly" 16 (1990), pp. 701–708.

All weights of fiber materials, base papers and coated papers and coatings refer to "oven-dried" weights. Information on the binder relates to the solid content of the binder.

The advantages of the web printing paper according to the invention related to economics result, first of all, from the high share of de-inked recycled fibers; according to an especially economic embodiment, all of the fiber used may consist of such fibers, and, secondly, from the relatively low grammage of the coating applied to both sides. The relatively low share of binder creates a further cost advantage. Preferably, the filler share is at least 15% by weight.

Attempts by the applicant to use a qualitatively higher-valued standard LWC base paper instead of the base paper of the present invention led to a paper quality that was completely unsatisfactory in respect to printing results. Thus, to this extent, it must be considered surprising that the combination according to the invention of a base paper containing a high share of recycled fiber and a high filler share and a coating applied in relatively low grammage, in which the pigment/binder ratio is also very low in comparison to the already known attempts to improve newsprint and SC quality, permits the object of the invention to be attained.

As already mentioned, it is preferred according to the invention that all of the fiber used consist of recycled fibers. According to a further embodiment, up to 30% by weight of the base paper, relative to its grammage, may consist of mechanical pulp, while in the case of base papers having a grammage of between 30 and 38 g/m$^2$, in particular, a chemical pulp share of up to 20% by weight is contemplated. Mechanical pulp and chemical pulp may also be used in mixture; however, their maximum share of the grammage of the base paper is <40% by weight.

In order to produce a web printing paper that meets the European standard for SC paper qualities, a base paper having a grammage of up to 48 g/m$^2$ and containing, relative to its grammage, 10 to 15% by weight filler has proved especially suitable, whereby the fiber used consists of more than 60% by weight de-inked recycled fibers and the remainder: mechanical pulp fiber and/or chemical pulp, with all of the components together equalling 100% by weight.

According to a further embodiment that is especially preferred in terms of economics, the fiber share in a base paper of this type consists exclusively of de-inked recycled fibers.

In order to produce a web printing paper of high value in respect to quality, which corresponds in its characteristics to the usual standard LWC papers, a base paper having a grammage of at least 38 g/m$^2$, preferably up to 58 g/m$^2$, has proved especially suitable. Such a base paper contains 20 to 35% by weight filler, 50 to 60% by weight de-inked recycled fibers, remainder: mechanical pulp and/or chemical pulp, whereby all components together add up to 100% by weight. Preferably, in such a paper, the fiber share consists exclusively of de-inked recycled fibers; however, it is possible, especially in base papers having a grammage between 38 g/m$^2$ and 45 g/m$^2$, by using up to 30% by weight mechanical pulp, as applicable, in combination with up to 20% by weight chemical pulp, to increase the strength characteristics.

In order to attain a sufficient whiteness, the recycled fibers are preferably additionally bleached, so that according to a further advantageous embodiment, a whiteness value of at least 60% results. It is especially preferred that the whiteness value of the recycled fibers be at least 65%, and very especially, at least 68%. The measurement of the whiteness value—also for the finished web printing paper—is carried out using Filter R457 as per DIN 5033, Parts 1 to 9 and DIN 53 145, Parts 1 and 2. According to a further preferred embodiment, however, the whiteness value is significantly higher, equaling up to 72%. For a base paper which, after being coated, is to correspond in its whiteness and brightness values to an SC paper, the value for whiteness is preferably 60 to 62. In a base paper which, after being coated, is to correspond in whiteness and/or brightness values to an LWC standard paper, the values for whiteness and brightness are preferably 68.

To attain the highest possible filler retention, a retention aid is added during the production of the base paper, as applicable, which is also contained in the base paper in small quantities. In order to improve strength, the base paper may also preferably contain cationic starch, the addition of which is also carried out as a mass addition.

Preferably, the mineral fillers of the base paper consist primarily of kaolin or calcium carbonate or talcum or a mixture of these substances.

In order to establish adequate strength, and especially adequate picking resistance on the surface, according to a preferred embodiment of the invention the binder share present in the coating is not to drop below 4% by weight, relative to the pigment in the coating. Furthermore, it has proved advantageous for the binder contained in the coating to consist of more than 50% by weight of a film-forming latex. For web printing papers to be printed in offset printing, polyvinyl alcohol in small quantities, preferably between 5 and 12% by weight, relative to the total binder content of the coating, may be present as further binder components in the coating. Preferably, latices based on acrylic acid ester, polyvinyl acetate and styrene-butadiene and/or their copolymerisates are used, as well as, especially, mixtures of these two latex types. Other than latex and, as applicable, polyvinyl alcohol, the coating may contain, as a further binder, starch and/or modified starch, e.g., starch ester. Especially for web printing papers to be printed in the offset printing process, the binder of the coating may also consist primarily of starch or, as applicable, only of starch.

The following have proved especially suitable as pigments to be used in the coating: kaolin, calcium carbonate, talcum, titanium dioxide, aluminum hydroxide, betonite or a mixture of these pigments, whereby bentonite is used with one or more of the above-mentioned pigments in a quantity of not more than 20% by weight, relative to the total pigment.

For a web printing paper with SC qualities, which is to be printed in offset printing, a coating in a quantity of 2 to 6/m$^2$ has proved suitable, whereby a binder share in the coating of 10 to 15% by weight, relative to the pigment of the coating, is present and the pigment consists of kaolin and/or calcium carbonate or of a mixture of kaolin and talcum or of a mixture of calcium carbonate and talcum and the pigment mixture, as applicable, also contains aluminum hydroxide and/or titanium dioxide in a quantity of not more than 20% by weight, relative to the total pigment.

A web printing paper with the quality features of an SC paper, which is to be printed in gravure printing, preferably has a coating of 4 to 8 g/m$^2$, whereby binder is present within the coating at a level of 4 to <10% by weight, relative to the pigment of the coating, and the pigment consists of kaolin, of calcium carbonate or of talcum or of a mixture of talcum with kaolin or calcium carbonate.

A preferred embodiment of a web printing paper which corresponds it its levels of quality to the known standard LWC papers and is printed in offset printing has a coating with a grammage of 2 to 6 g/m$^2$, whereby the quantity of the binder present in the coating is 10 to 15%, relative to the pigment in the coating, and the pigment consist of kaolin and/or calcium carbonate, or of a mixture of kaolin and talcum or of a mixture of calcium carbonate and talcum, and the pigment mixture, as applicable, also contains aluminum hydroxide and/or titanium dioxide in a quantity of not more than 20% by weight, relative to the total pigment.

For a web printing paper which is to have a quality level corresponding to the known standard LWC papers but is to be used for gravure printing, the grammage of the coating is 4 to 8 g/m$^2$ and the binder is present in a quantity of 4 to <10% relative to the pigment of the coating. As pigment, kaolin or calcium carbonate or talcum or a mixture of talcum with kaolin or calcium carbonate is used.

In the two above-described web printing papers for gravure printing, the binder share is preferably not more than 6% by weight, relative to the pigment in the coating.

Table 1 below shows the characteristic values of web printing papers according to the invention in various area-weight ranges.

TABLE 1

| | Grammage g/m$^2$ | Opacity % | Whiteness R 457 | Brightness | Gloss 75° | Smoothness Bekk s |
|---|---|---|---|---|---|---|
| IO | 51 | 90 | 72 | 77 | 45 | 1,000 |
| | 57 | 92 | 72 | 78 | 55 | 1,500 |
| IT | 51 | 91 | 72 | 77 | 43 | 1,700 |
| | 60 | 93 | 72 | 77 | 50 | 2,000 |
| IIO | 52 | 88 | 67 | 72 | 41 | 1,200 |
| | 60 | 90 | 67 | 72 | 43 | 1,300 |
| IIT | 52 | 90 | 67 | 72 | 42 | 1,500 |
| | 60 | 92 | 67 | 72 | 45 | 1,600 |

In the above table, the following meanings apply:

I Filler share>20%

II Filler share<15%

O Offset quality

T Gravure quality

Because the waste paper from which the recycled fibers to be used according to the invention are obtained contains a certain share of calcium carbonate and at least part of this calcium carbonate, together with the recycled fibers and other possible mineral fillers, is added to the mass from which the base paper is produced, a low-acid or neutral method has proved advantageous, in order to prevent, as far as possible, gypsum formation, which will occur due to the interaction of aluminum sulfate and calcium carbonate under acidic conditions. The use of the mineral pigments contained in the water paper material, which essentially consist, along with calcium carbonate, of kaolin, is by no means undesirable, however; rather, according to the invention an effort is made to reintroduce the highest possible share of these pigments into the paper production process together with the recycled fibers. It has proved advantageous to omit any washing process while recovering the recycled fibers when a higher share of the fillers contained in the waste paper are to be recycled. However, if the waste paper to be used contains a high filler share and, in addition, if an even higher share of recycled fibers are to be used, and if only moderate filler content is called for in the base paper to be produced, then a certain degree of washing may be desired, especially with a filler share of <15% by weight.

The relatively high share of filler, especially filler contents of more than 15% by weight, may lead to an uneven filler distribution across the cross-section of the base paper. Preferably, therefore, a so-called twin-former is used to produce the base paper, with which the dehydration of the formed paper web is carried out simultaneously on both sides between two wires.

If, according to a particularly preferred embodiment of the process according to the invention, the coating of the base paper is carried out by means of a film press, a web printing paper of satisfactory gloss, good smoothness and sufficient picking resistance is created, despite the low grammage of the coating compared to LWC papers, although a relatively lower binder/pigment ratio exists. It is already known that there is an interaction between the high filler share of the base paper, the indirect application of the coating and its composition, with the result that during the coating process the still-fluid coating mass penetrates into the base paper only so far that a good connection results between the base paper and coating, while the majority of the coating mass is available for formation of the coating paper surface.

The coating can also be applied in two worksteps in such a manner that first a pre-coat and then a top coat is applied; however, the application of the coating in a single workstep is preferred.

In order to form a sufficiently smooth and glossy coating, the web printing paper is, after the application and drying of the coating, treated on a standard super-calendar or hot-soft calendar.

According to a further preferred embodiment of the invention, production is carried out on-line, i.e., the base paper, after it dries, is fed directly to the coater for application of the coating and, as applicable, satinized directly following the application and drying of the coating, without intermediate winding.

The following examples serve to explain the invention in greater detail:

EXAMPLE 1

On a long-sieve paper machine, with a grammage of 45 g/m$^2$, a base paper consisting of:

62% by weight de-inked recycled fibers

24% by weight wood pulp (TMP)

14% by weight filler is produced.

Whiteness of recycled fibers: 61%

Grinding degree of mechanical pulp: 70 degrees SR

Filler components:

65% by weight kaolin

35% by weight calcium carbonate

10% by weight talcum

With a coater known in the literature as a "speed-sizer," a coating is applied to the dried base paper web having a grammage of 5.5 g/m$^2$ each side and satinized after drying on a super-calendar. The pigment composition of the applied pigment consists of:

70% by weight kaolin

30% by weight talcum and has a binder share of 5% by weight, relative to the total pigment share, consisting of butadiene styrene latex. In a lesser quantity, the coating mass used for producing the coating also contains additives for improved rheology.

The result is a web printing paper to be printed using the gravure process, which has the characteristics indicated in Table 2.

EXAMPLE 2

Under the same conditions as those described in Example 1, a base paper is produced that has the following composition:

62% by weight de-inked and bleached recycled fibers having a whiteness value of 66%

28% by weight filler

10% by weight mechanical pulp

Filler composition and grinding degree of the mechanical pulp correspond to Example 1. The base paper has a grammage of 49 g/m$^2$ and is coated with the coating described in Example 1, but with a grammage of 5.5 g/m$^2$ each side.

The result is a web printing paper to be printed using the gravure process, which has the characteristics indicated in Table 2.

EXAMPLES 3 AND 4

In order to produce web printing papers to be printed in offset printing, base papers having the composition indicated in Examples 1 and 2 are provided with a coating, the pigment share of which consists of 30% by weight kaolin and 70% by weight calcium carbonate; the coating contains 13% by weight binder, consisting of 11% by weight of a butadiene styrol latex and 2% by weight starch as well as an optical lightener added in the usual amount. After the coating dries, the papers are treated on a super-calendar. The base paper used in Example 3 corresponds to that described in Example 1; in Example 4, the base paper described in Example 2 was used, but with a grammage of 49 g/m$^2$. According to Example 3, 4.5 g/m$^2$ each side were applied; according to Example 4, 4 g/m$^2$ each side. The characteristics of the produced papers are also found in Table 2.

TABLE 2

| Example | Smoothness Bekk s | Gloss 75° | Whiteness | Opacity |
|---|---|---|---|---|
| 1 | 1,100 | 40 | 66 | 96 |
| 2 | 1,300 | 51 | 72 | 94 |
| 3 | 1,000 | 38 | 64 | 95 |
| 4 | 1,100 | 53 | 72 | 93 |

What is claimed is:

1. A web printing paper, comprising a base paper containing mineral filler, recycled fibers, and one of mechanical pulp and chemical pulp, and having a coating on both sides of said base paper, said coating containing a binder and a pigment, said pigment consisting of kaolin, calcium carbonate, talcum, titanium dioxide, aluminum hydroxide or mixtures thereof, said base paper having a grammage of 30 to less than 60 g/m$^2$, and relative to its grammage, contains greater than 50% by weight de-inked recycled fibers, 10 to 35% by weight mineral filler, the remainder being one of mechanical pulp and chemical pulp, all weight pans adding up to 100% by weight; and the costing per side having a grammage of 2 to 8 g/m$^2$ and the binder, relative to pigment of coating, being present in a quantity of not more than 15% by weight.

2. The web printing paper of claim 1, wherein the mineral filler is present in an amount of at least 15% by weight.

3. The web printing paper of claim 1, wherein the base paper relative to its grammage contains one of up to 30% by weight mechanical pulp and up to 20% by weight chemical pulp.

4. The web printing paper of claim 1, wherein the base paper, relative to its grammage, contains more than 60% by weight de-inked recycled fibers, 10 to 15% by weight mineral filler, the remainder being one of mechanical pulp and chemical pulp, all weight parts adding up to 100% by weight and the base paper has a grammage of up to 48 g/m$^2$.

5. The web printing paper as in claim 1, wherein the base paper, relative to its grammage, comprises:

20 to 35% by weight filler, less than 50 to 60% by weight de-inked recycled fibers and one of up to 30% by weight mechanical pulp, and up to 20% by weight chemical pulp all weight parts adding up to 100% by weight and the base paper has a grammage of at least 38 g/m$^2$.

6. The web printing paper of claim 1, wherein the recycled fibers are bleached.

7. The web printing paper of claim 1, wherein the recycled fibers have a whiteness of at least 60%.

8. The web printing paper of claim 1, wherein the base paper additionally contains a retention aid for the filler.

9. The web printing paper of claim 1, wherein the base paper additionally contains cationic starch.

10. The web printing paper of claim 1, wherein the mineral filler of the base paper comprises kaolin, calcium carbonate, talcum or a mixture thereof.

11. The web printing paper of claim 1, wherein the binder contained in the coating equals not less that 4% by weight, relative to the pigment of the coating.

12. The web printing paper of claim 1, wherein the binder contained in the coating comprises more than 50% by weight of a film-forming latex.

13. The web printing paper of claim 1, wherein the coating contains, as binder, polyvinyl alcohol in a quantity of 5 to 15% by weight, relative to the total binder content of the coating.

14. The web printing paper of claim 1, wherein:

the coating per side has a grammage of 2 to 6 g/m$^2$, the binder is present in the coating in a quantity of 10 to 15% by weight relative to the pigment of the coating, the pigment consists of one of kaolin and calcium carbonate, or a mixture of kaolin and talcum or a mixture of calcium carbonate and talcum, and in the pigment mixture, optionally, one of aluminum hydroxide and titanium dioxide is present in an amount of not more that 20% by weight, relative to the total pigment.

15. The web printing paper of claim 1, wherein:

the coating per side has a grammage of 4 to 8 g/m$^2$, the binder is present in the coating in an amount of 4 to less than 10% by weight relative to the pigment of the coating, the pigment consists of one of kaolin and calcium carbonate; or a mixture of kaolin and talcum, or of a mixture of calcium carbonate and talcum; and in the pigment mixture, optionally, one of aluminum hydroxide and titanium dioxide is present in an amount of not more than 20% by weight, relative to the total pigment.

16. The web printing paper of claim 1, wherein:

the coating per side has a grammage of 2 to 6 g/m$^2$, the binder is present in the coating is a quantity of 10 to 15% by weight, relative to the pigment in the coating, the pigment consists of one of kaolin and calcium carbonate; or of a mixture of kaolin and talcum, or of a mixture of calcium carbonate and talcum; and in the pigment mixture, optionally, one of aluminum hydroxide and titanium dioxide is present in a quantity of not more than 20% by weight, relative to the total pigment.

17. The web printing paper of claim 1, wherein:

the coating per side has a grammage of 4 to 8 g/m$^2$, the binder is present in the coating in an amount of 4 to less than 10%, relative to the pigment of the coating, the pigment consists of one of kaolin and talcum; or of calcium carbonate or of calcium carbonate and talcum.

18. A web printing paper, comprising a base paper containing mineral filler and recycled fibers and on both sides of said base paper, said coating containing a binder and a pigment, said pigment consisting of kaolin, calcium carbonate, talcum, titanium dioxide, aluminum hydroxide or mixtures thereof;

said base paper having a grammage of 30 to less than 60 g/m$^2$ and containing, relative to its grammage, 10 to 35% by weight mineral filler; the remainder being de-inked recycled fibers, all weight parts adding up to 100% by weight; and the coating per side having a grammage of 2 to 8 g/m$^2$ and the binder, relative to pigment in the coating, being present in a quantity of not more than 15% by weight.

19. The web printing paper of claim 18, wherein the base paper relative to its grammage contains 10 to 15% by weight mineral filler, the remainder being de-inked recycled fibers, and the base paper has a grammage up to 48 g/m$^2$.

20. The web printing paper of claim 18, wherein the base paper, relative to its grammage, comprises:

20 to 35% by weight filler, the remainder being de-inked recycled fibers, and the base paper has a grammage of at least 38 g/m$^2$.

21. The web printing paper of claim 20, wherein the base paper has a grammage of up to 58 g/m$^2$.

22. The web printing paper of claim 18, wherein the mineral filler is present in an amount of at least 15% by weight.

23. The web printing paper of claim 22, wherein the base paper relative to its grammage contains one of up to 30% by weight mechanical pulp and up to 20% by weight chemical pulp.

24. The web printing paper of claim 18, wherein the recycled fibers are bleached.

25. The web printing paper of claim 18, wherein the recycled fibers have a whiteness of at least 60%.

26. The web printing paper of claim 18, wherein the base paper additionally contains a retention aid for the filler.

27. The web printing paper of claim 18, wherein the base paper additionally contains cationic starch.

28. The web printing paper of claim 18, wherein the mineral filler of the base paper comprises kaolin, calcium carbonate, talcum or a mixture thereof.

29. The web printing paper of claim 18, wherein the binder contained in the coating equals not less that 4% by weight, relative to the pigment of the coating.

30. The web printing paper of claim 18, wherein the binder contained in the coating comprises more than 50% by weight of a film-forming latex.

31. The web printing paper of claim 18, wherein the coating contains, as binder, polyvinyl alcohol in a quantity of 5 to 15% by weight, relative to the total binder content of the coating.

32. The web printing paper of claim 18, wherein:

the coating per side has a grammage of 2 to 6 g/m$^2$, the binder is present in the coating in a quantity of 10 to 15% by weight relative to the pigment of the coating, the pigment consists of one of kaolin and calcium carbonate, or a mixture of kaolin and talcum or a mixture of calcium carbonate and talcum and in the pigment mixture, optionally, one of aluminum hydroxide and titanium dioxide is present in an amount of not more that 20% by weight, relative to the total pigment.

33. The web printing paper of claim 18, wherein;

the coating per side has a grammage of 4 to 8 g/m$^2$, the binder is present in the coating in an amount of 4 to less than 10% by weight relative to the pigment of the coating, the pigment consists of one of kaolin and calcium carbonate; or a mixture of kaolin and talcum, or of a mixture of calcium carbonate and talcum; and in the pigment mixture, optionally, one of aluminum hydroxide and titanium dioxide is present in an amount of not more than 20% by weight, relative to the total pigment.

34. The web printing paper of claim 18, wherein:

the coating per side has a grammage of 2 to 6 g/m$^2$, the binder is present in the coating is a quantity of 10 to 15% by weight, relative to the pigment in the coating, the pigment consists of one of kaolin and calcium carbonate; or of a mixture of kaolin and talcum, or of a mixture of calcium carbonate and talcum, and in the pigment mixture, optionally, one of aluminum hydroxide and titanium dioxide is present in a quantity of not more than 20% by weight, relative to the total pigment.

35. The web printing paper of claim 18, wherein:

the coating per side has a grammage of 4 to 8 g/m$^2$, the binder is present in the coating in an amount of 4 to less than 10%, relative to the pigment of the coating, the pigment consists of one of kaolin and talcum; or of calcium carbonate or of calcium carbonate and talcum.

36. A process for producing a web printing paper, comprising a base paper containing mineral filler, recycled fibers, and one of mechanical pulp and chemical pulp, and having a coating on both sides of said base paper, said coating containing a binder and a pigment, said pigment consisting of kaolin, calcium carbonate, talcum, titanium dioxide, aluminum hydroxide, or mixtures thereof; said base paper having a grammage of 30 to less than 60 g/m$^2$, and relative to its grammage, contains greater than 50% by weight de-inked recycled fibers, 10 to 35% by weight mineral filler, the remainder being one of mechanical pulp and chemical pulp, all weight parts adding up to 100% by weight; and the coating per side having a grammage of 2 to 8 g/m$^2$ and the binder, relative to pigment of coating, being present in a quantity of not more than 15% by weight wherein the production of the base paper is carried out at a pH value of between 6.5 and 8.5.

37. The process of claim 36, wherein the recycled fibers originate from waste paper material and wherein the waste paper material is dissolved and the dissolved waste paper material and the recycled fibers are not washed for retaining the highest possible share of the mineral pigment.

38. The process of claim 36, wherein the base paper is dewatered and the dewatering is carried out simultaneously on both sides between two wires of a paper machine.

39. The process of claim 36, wherein the coating is applied by means of a film press.

40. The process of claim 36, wherein the coating comprises a pre-coat and a top coat.

41. The process of claim 36, comprising the steps of coating the paper and drying the coating; and wherein the web printing paper is treated, after the coating is dried on a super-calendar or a hot-soft calendar.

* * * * *